US007265305B2

(12) United States Patent
Chiu

(10) Patent No.: US 7,265,305 B2
(45) Date of Patent: Sep. 4, 2007

(54) MULTIPLE SWITCH DEVICE AND ELECTRONIC DEVICE EMPLOYING THE SAME

(75) Inventor: Ming-Chien Chiu, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,475

(22) Filed: Aug. 11, 2006

(65) Prior Publication Data

US 2007/0074961 A1 Apr. 5, 2007

(30) Foreign Application Priority Data

Sep. 9, 2005 (TW) ..... 94131014

(51) Int. Cl.
*H01H 9/26* (2006.01)

(52) U.S. Cl. ..... 200/50.32; 200/331

(58) Field of Classification Search ..... 200/1 R, 200/17 R, 18, 50.01, 50.32, 50.33, 50.36, 200/50.37, 572, 573, 574, 50.06, 43.04, 43.06, 200/43.07, 43.08, 331, 330
See application file for complete search history.

(56) References Cited

U.S. PATENT DOCUMENTS

| | | | | |
|---|---|---|---|---|
| 5,508,480 | A * | 4/1996 | Quinlan | 200/16 A |
| 5,817,996 | A * | 10/1998 | Ulrich et al. | 200/4 |
| 5,989,043 | A | 11/1999 | Han et al. | |
| 6,198,058 | B1 * | 3/2001 | Graninger et al. | 200/50.02 |
| 6,693,248 | B1 * | 2/2004 | Schultz | 200/11 TC |
| 6,787,717 | B2 * | 9/2004 | Jorczak | 200/17 R |

* cited by examiner

*Primary Examiner*—Michael A Friedhofer
(74) *Attorney, Agent, or Firm*—Wei Te Chung

(57) ABSTRACT

A multiple switch device for controlling and linking a plurality of switches (600) disposed on a circuit board (500) comprises an operation button (110), a shaft (120), and at least one fixing base (130). The operation button comprises a handle (112) and a rod (114) fixed to the handle. The shaft comprises a connecting plate (122) disposed at an end of the shaft, and a plurality of protruding plates (124) disposed on the shaft. The rod is engaged with the connecting plate to securely connect the shaft and the operation button. Each of the protruding plates aligns with a corresponding switch. The fixing base supports the shaft on a circuit board.

18 Claims, 7 Drawing Sheets

MULTIPLE SWITCH DEVICE AND ELECTRONIC DEVICE EMPLOYING THE SAME

FIELD OF THE INVENTION

The invention relates to a multiple switch device, and particularly to a multiple switch device for linking and controlling a plurality of switches simultaneously.

DESCRIPTION OF RELATED ART

As electronic devices become more highly-integrated and complicated, greater numbers of input/output ports are employed.

When the electronic device should be reset, the plurality of input/output ports must be turned on/off at the same time. A conventional normal switch will not control the plurality of ports simultaneously. When the electronic device has multiple ports, there are a plurality of switches in the electronic device, and it is difficult to turn on/off all the switches at the same time.

SUMMARY OF THE INVENTION

An exemplary embodiment of the invention provides a multiple switch device. The multiple switch device for linking and controlling a plurality of switches disposed on a circuit board includes an operation button, a shaft, and at least one fixing base. The operation button includes a handle and a rod fixed to the handle. The shaft includes a connecting plate disposed at an end of the shaft, and a plurality of protruding plates disposed on the shaft. The rod is engaged with the connecting plate to securely connect the shaft and the operation button. Each of the protruding plates corresponds to one of the switches. The fixing base supports the shaft on the circuit board.

An another exemplary embodiment of the invention provides an electronic device. The electronic device includes an operation button, a faceplate, a shaft, at least one fixing base, and a printed circuit board. The operation button includes a handle and a rod fixed to the handle. The faceplate includes a hole and the operation button is inserted through the hole. The shaft includes a connecting plate disposed at an end of the shaft, and a plurality of protruding plates disposed on the shaft. The rod is engaged with the connecting plate to securely connect the shaft and the operation button. The fixing base supports the shaft. The printed circuit board includes a plurality of switches disposed thereon. Each of the protruding plates corresponds to one of the switches respectively, and when the shaft is moved by the handle, the protruding plates control the switches.

Other advantages and novel features will be drawn from the following detailed description of embodiments with the attached drawings, in which:

DETAILED DESCRIPTION OF THE INVENTION

Figure 1:
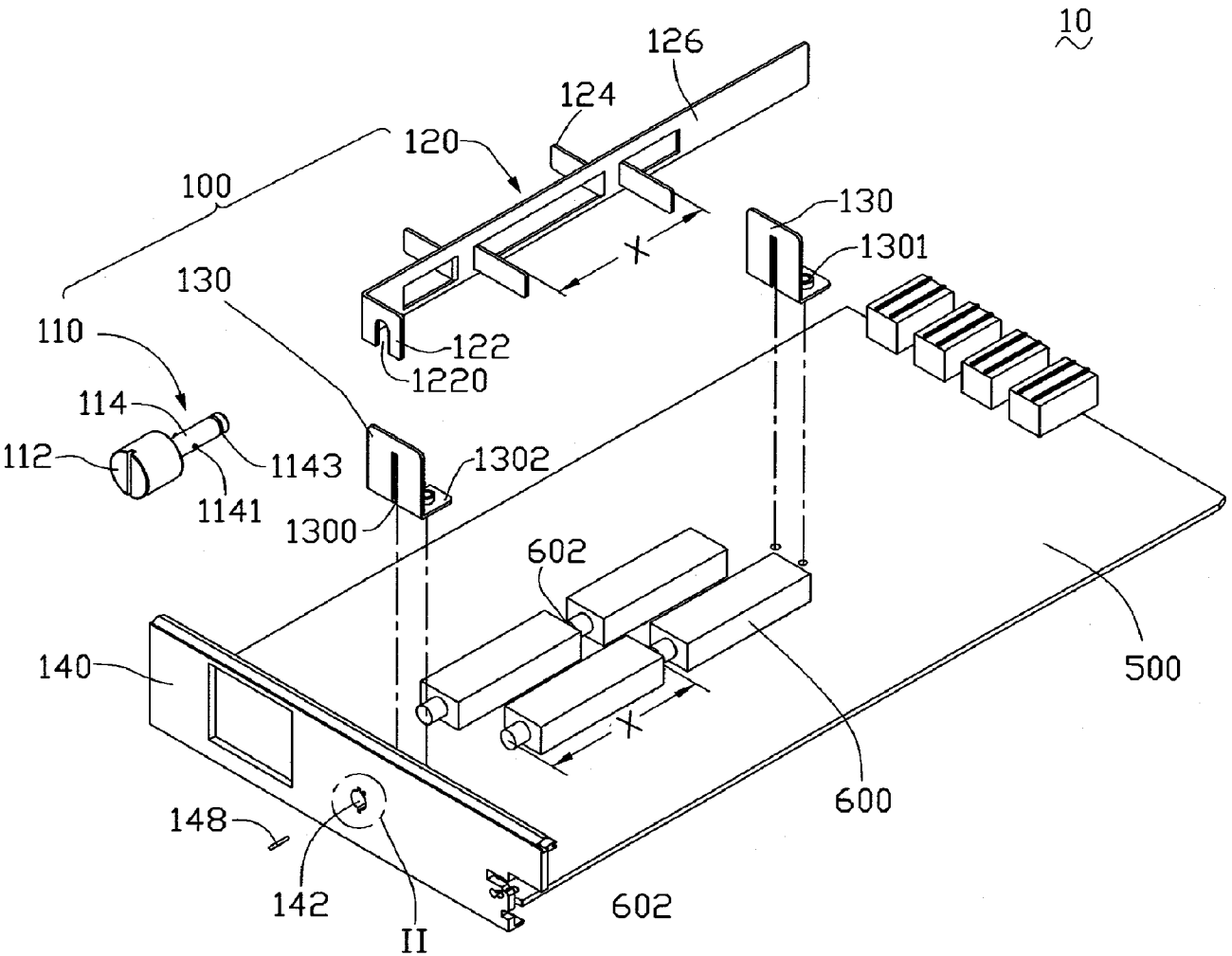
FIG. 1 is an exploded, isometric view of an electronic device of an exemplary embodiment of the invention.

FIG. 1 is an exploded view of an electronic device 10 of an exemplary embodiment of the invention. In the exemplary embodiment, the electronic device 10 includes a multiple switch device 100, a faceplate 140, and a circuit board 500. The multiple switch device 100 disposed on the circuit board 500 includes an operation button 110, a shaft 120, and a pair of L-shaped fixing bases 130. The circuit board 500 includes a plurality of switches 600, and each switch 600 is disposed in parallel on the circuit board 500. A distance between two adjacent switches 600 fixed on the circuit board 500 is designated as "X". The faceplate includes a hole 142, and the operation button 110 is inserted through the hole 142.

The operation button 110 includes a handle 112 and a rod 114. The rod 114 and the handle 112 are formed as a single piece. In the exemplary embodiment, the handle 112 and the rod 114 are column-shaped, and a diameter of the handle 112 is greater than that of the rod 114. The rod 114 includes a pair of positioning pins 1141 and a recessed portion 1143 defined at an end thereof. The two positioning pins 1141 adjacent to the handle 112 symmetrically protrude from a surface of the rod 114.

Figure 2:
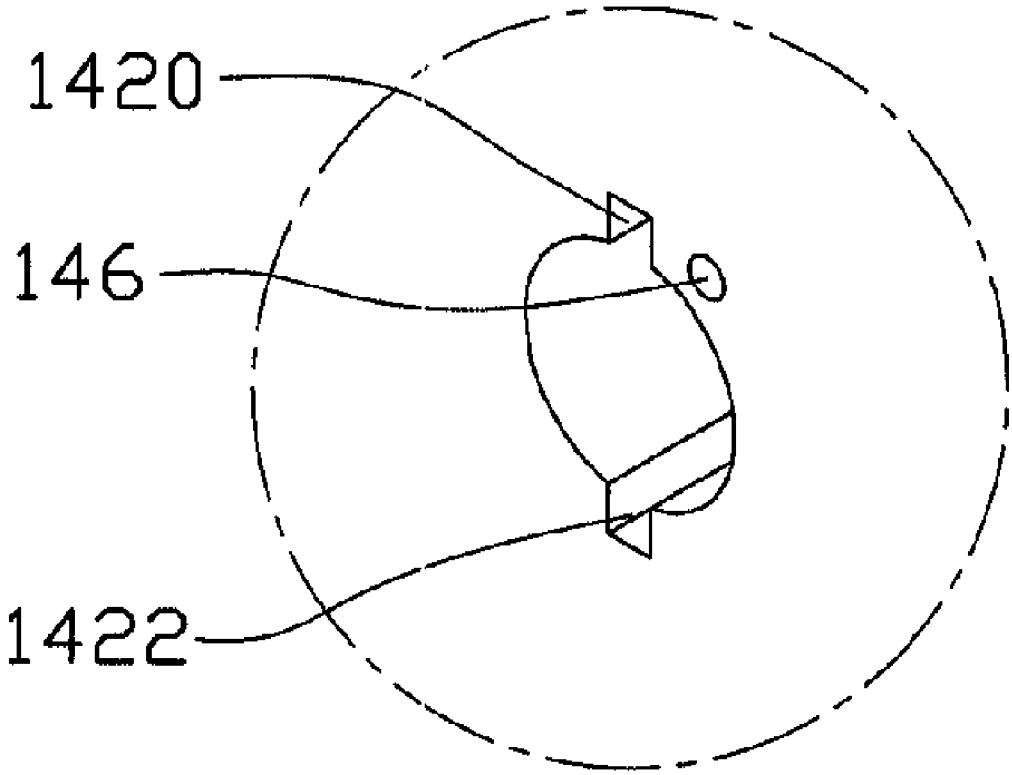
FIG. 2 is an enlarged view of a circled portion II of FIG. 1.

Referring to FIGS. 1 and 2, a first concave portion 1420 and a second concave portion 1422 defined in an inner wall of the hole 142 are parallel with each other, and the first and second concave portions 1420, 1422 are used for receiving the positioning pins 1141, respectively. In the exemplary embodiment, since widths of the first concave portion 1420 and the second concave portion 1422 are greater than lengths of the positioning pins 1141 respectively, therefore, the positioning pins 1141 are freely received in the first concave 1420 and the second concave 1422. A receiving hole 146 between the first concave portion 1420 and the second concave portion 1422 is defined in an inner wall encompassing the hole 142, the receiving hole 146 is for receiving a restraining pin 148. The restraining pin 148 and the positioning pin 1141 cooperatively restrict a movement of the operation button 110 in a clockwise or counterclockwise direction. In an alterative embodiment, the restraining pin 148 may be riveted to or welded on the faceplate 140, or the restraining pin 148 and the faceplate 140 are formed integrally as a single piece.

The shaft 120 includes a main body 126 and a connecting plate 122. In the exemplary embodiment, the main body 126 and the connecting plate 122 are formed integrally as a single piece. The connecting plate 122 disposed on an end of the shaft 120 defines a U-shaped hole 1220 in a vertical direction. The recessed portion 1143 of the rod 114 is received in the U-shaped hole 1220 to connect the shaft 120 and the operation button 110. The main body 126 includes a plurality of protruding plates 124 disposed at two sides of the main body 126 with the distance "X" between each two adjacent protruding plates 124 thus aligning with the switches 600 respectively.

Each of the fixing bases 130 includes a slot 1300 and a bottom portion 1302. The end of the shaft 120 is received in the slot 1300, thereby the fixing base 130 is fixed to the shaft 120. The fixing base 130 is mounted to the circuit board 500 via a bolt 1301 engaged with the bottom portion 1302. In other embodiments, the bolt 1301 can be eliminated, and the bottom portion 1302 is welded on the printed circuit board 500 to assemble the shaft 120 and the circuit board 500 together.

Figure 3:
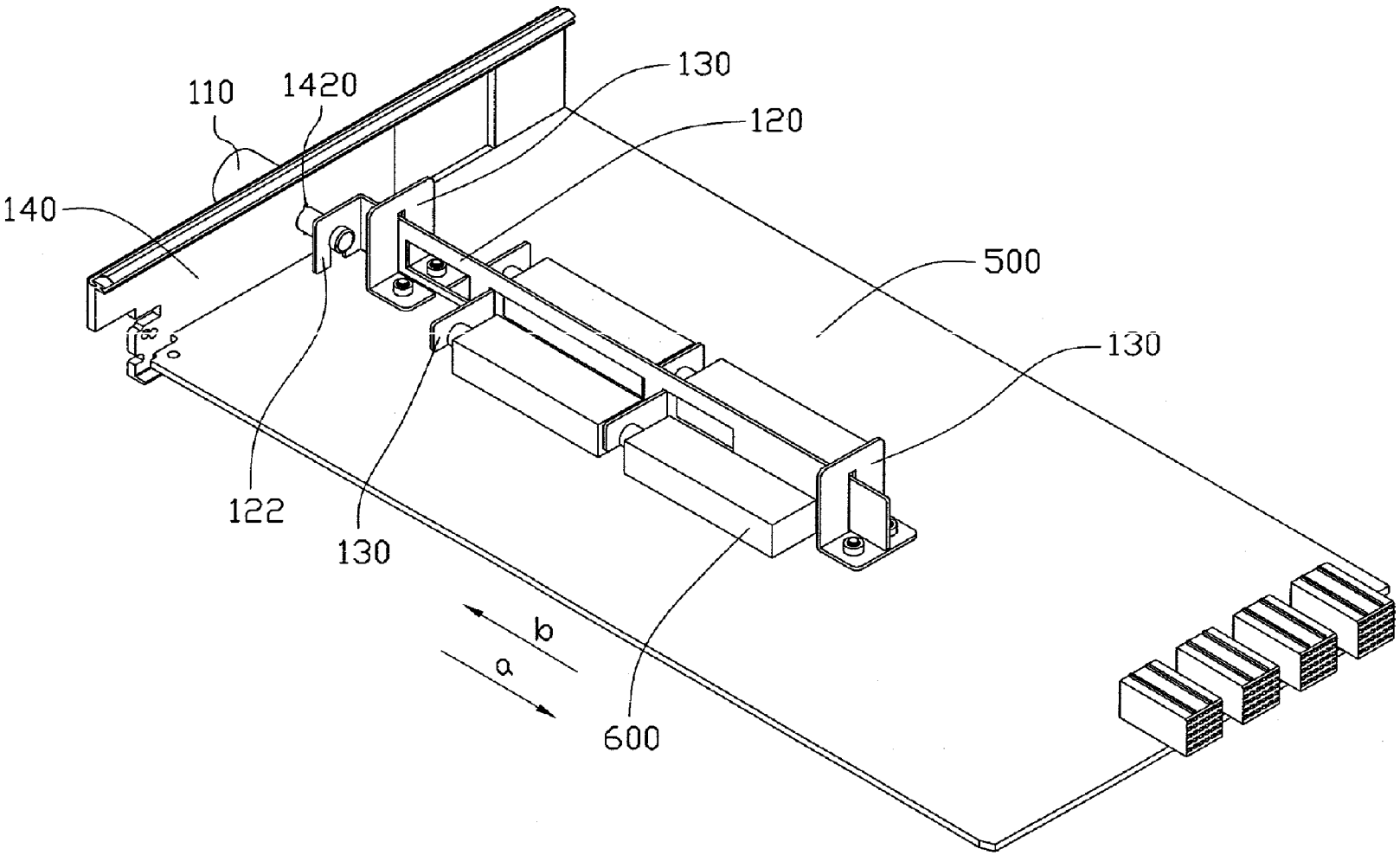
FIG. 3 is an assembled view of FIG. 1.
Figure 4:
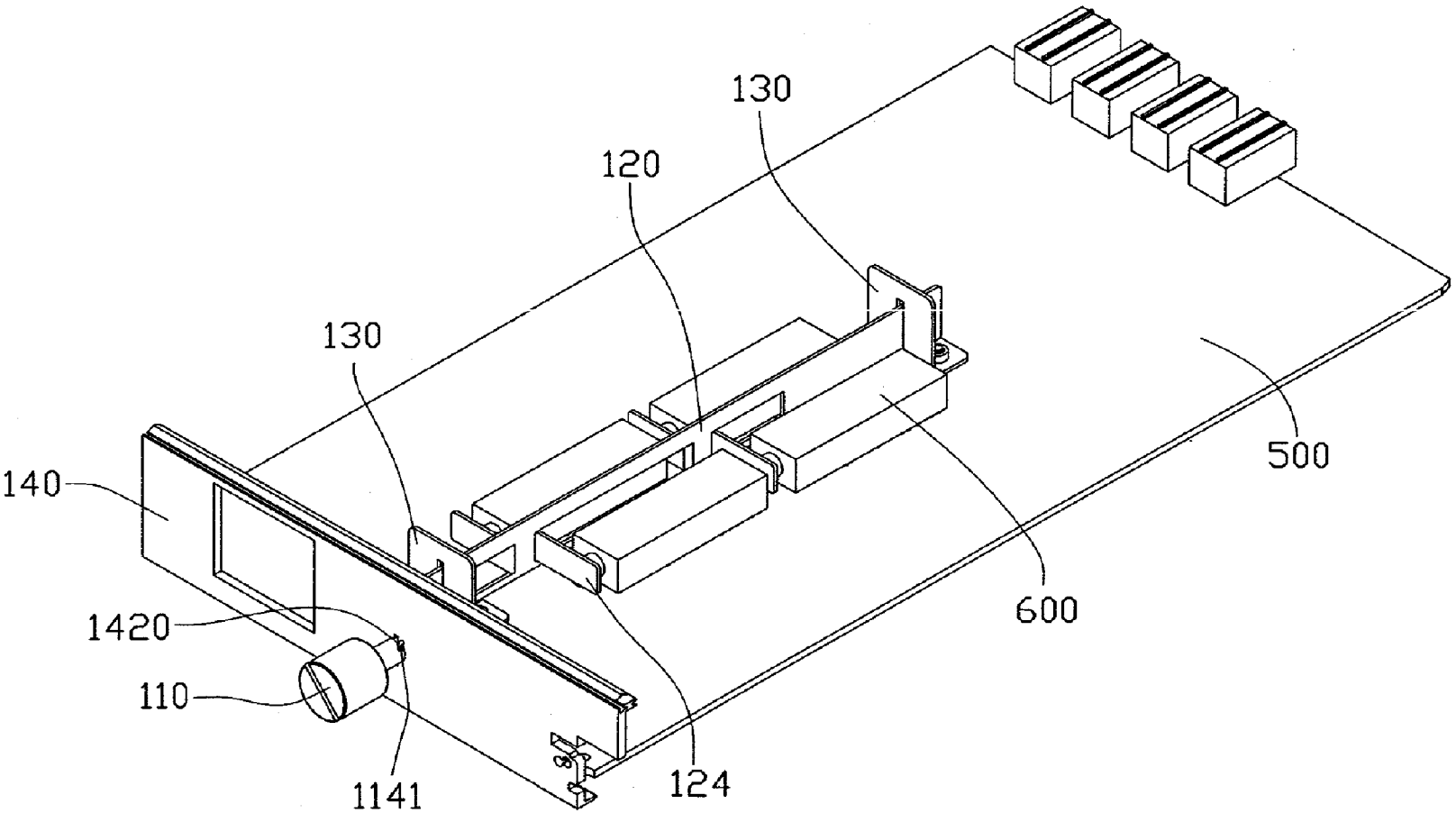
FIG. 4 is similar to FIG. 3, but viewed from another aspect.

Referring also to FIGS. 3 and 4 showing different viewing angles, in assembly, the rod 114 passes through the hole 142, and the recessed portion 1143 is received in the U-shaped hole 1220 of the connecting plate 122, and thus the operation button 110 and the shaft 120 are assembled together. In this assembled position, each of the protruding plates 124 of the shaft 120 corresponds to each of the switches 600 on the circuit board 500.

Figure 5:
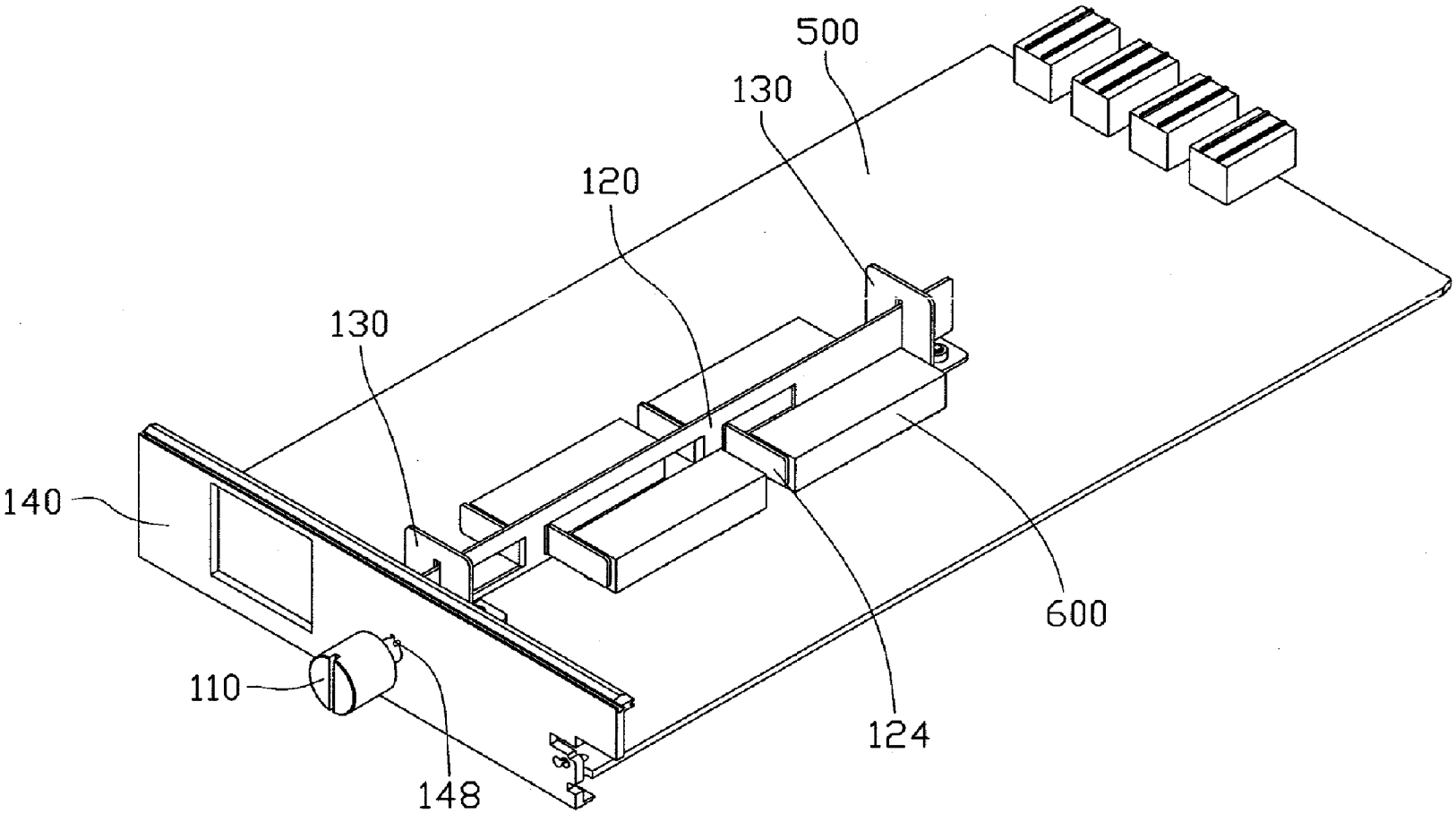
FIG. 5 is an assembled view of FIG. 1 and showing switches of the electronic device being depressed.

Referring also to FIGS. 4 and 5, in use, the operation button 110 is rotated until the positioning pins 1141 correspond to the first concave portion 1420 and the second concave portion 1422 respectively. Then the operation button 110 is pressed until the positioning pins 1141 extend through the first concave portion 1420 and the second concave portion 1422 so that the rod 114 drives the shaft 120 to move along a direction of an arrow "a". Thus, the protruding plates 124 are driven to move along the direction of the arrow "a" to press on the switches 600, and the multiple linked switches 600 are turned on at the same time.

Alternatively, the handle 112 of the operation button 110 is rotated until the positioning pins 1141 correspond to the first concave portion 1420 and the second concave portion 1422 respectively. Then the operation button 110 is pressed to drive the shaft 120 to move along a direction of an arrow "b" opposite to the direction of the arrow "a". Thus, the protruding plates 124 are driven to move along the direction of the arrow "b" to release the switches 600, and therefore, the multiple linked switches 600 are turned off at the same time.

Figure 6:
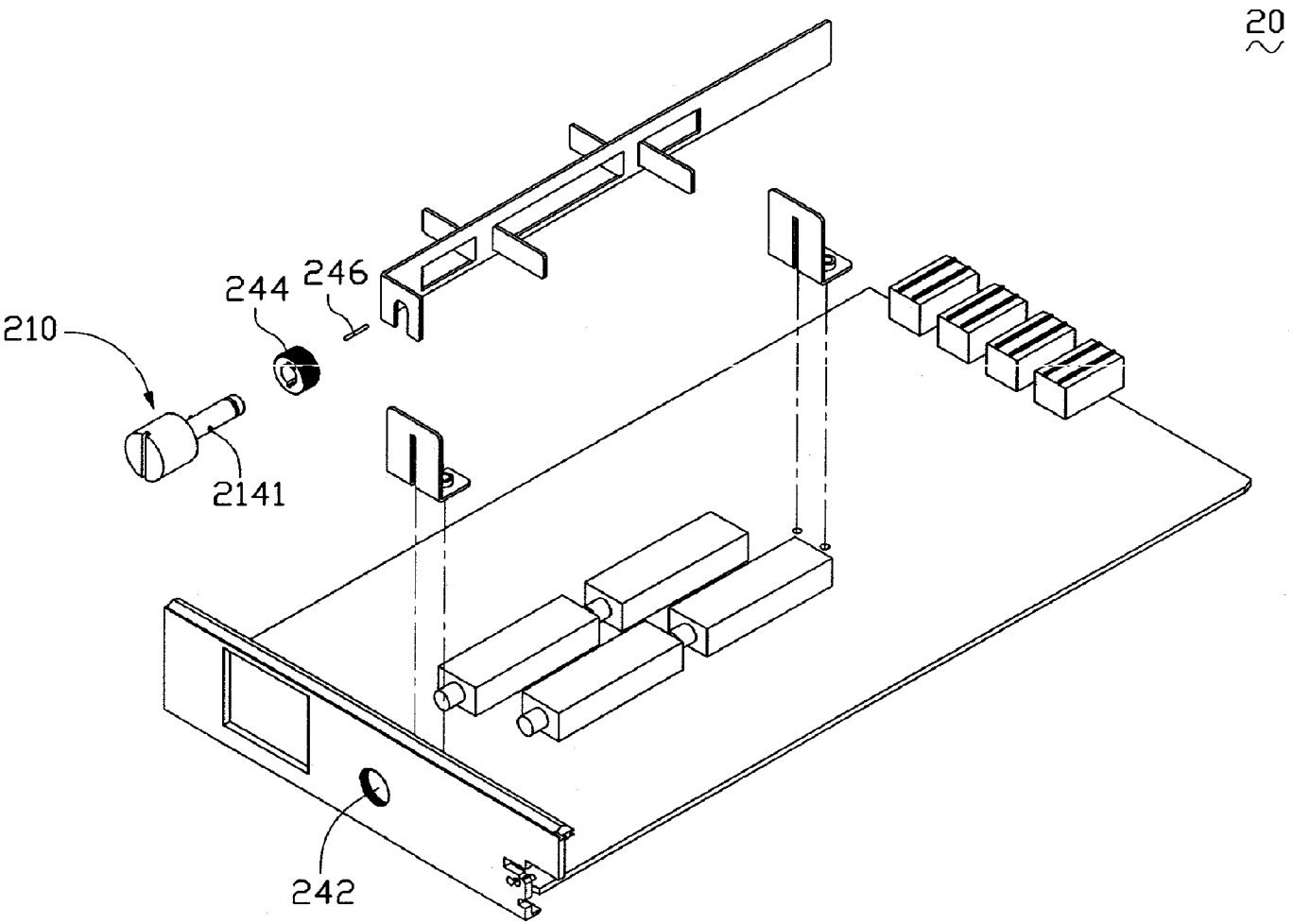
FIG. 6 is an exploded view of a multiple switch device of another exemplary embodiment of the invention.
Figure 7:
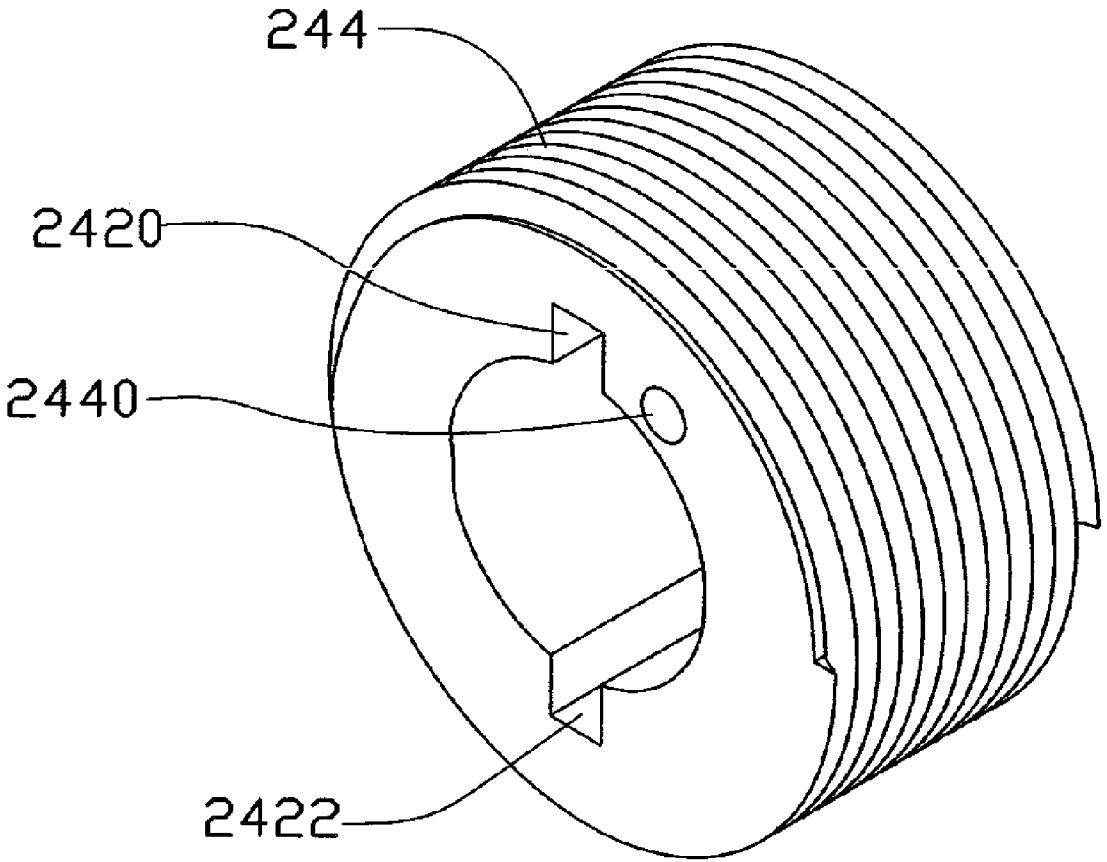
FIG. 7 is an enlarged view of a nut of FIG. 6.

Referring to FIGS. 6 and 7, a multiple switch device 20 of another embodiment of the present invention is shown. The elements, construction, and function of the exemplary embodiment are the same as the foregoing exemplary embodiment, except that the multiple switch device 20 further includes a nut 244. The nut 244 received in a hole 242 of a faceplate 242 includes a first concave portion 2420 and a second concave portion 2422 for receiving position pins 2141, as shown in FIG. 7. The nut 244 further includes a restraining pin 246. In the exemplary embodiment, the restraining pin 246 is received in a hole 2440 defined between the first concave portion 2420 and the second concave portion 2422. In an alterative embodiment, the restraining pin 246 may be riveted to or welded on the nut 244, or the restraining pin 246 and the nut 244 are formed integrally as a single piece.

While embodiments of the present invention have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A multiple switch device for controlling and linking a plurality of switches disposed on a circuit board, comprising:

an operation button, comprising a handle and a rod fixed to the handle;

a shaft, comprising a connecting plate disposed at an end of the shaft, and a plurality of protruding plates disposed on the shaft;

wherein the rod is engaged with the connecting plate to securely connect the shaft and the operation button; and each of the protruding plates aligns with a corresponding one of the plurality of switches; and at least one fixing base, supporting the shaft on the circuit board.

2. The multiple switch device as claimed in claim 1, wherein the rod of the operation button comprises a recessed portion, formed in a vicinity of an end of the rod.

3. The multiple switch device as claimed in claim 2, wherein the connecting plate comprises a U-shaped hole, defined in the recessed portion of the rod.

4. The multiple switch device as claimed in claim 1, wherein the at least one fixing base is L-shaped.

5. The multiple switch device as claimed in claim 1, wherein the at least one fixing base comprises a bottom portion and a slot formed therein.

6. An electronic device, comprising:

an operation button, comprising a handle and a rod fixed to the handle;

a faceplate, comprising a hole; wherein the operation button is inserted through the hole;

a shaft, comprising a connecting plate disposed at an end of the shaft, and a plurality of protruding plates disposed on the shaft; wherein the rod is engaged with the connecting plate to securely connect the shaft and the operation button;

at least one fixing base, supporting the shaft; and a printed circuit board, comprising a plurality of switches disposed thereon; wherein each of the protruding plates aligns with a corresponding one of the plurality of switches, and when the shaft is moved by the handle, the protruding plates are controlled to operate the switches.

7. The electronic device as claimed in claim 6, wherein the rod comprises a pair of positioning pins and a recessed portion, the positioning pins are symmetrically disposed at an end of the rod in vicinity of the handle, and the recessed portion is disposed at the other end of the rod.

8. The electronic device as claimed in claim 7, wherein the faceplate further comprises at least one pair of concave portions formed in a wall encompassing the hole.

9. The electronic device as claimed in claim 7, wherein the connecting plate comprises a U-shaped hole, formed in the recessed portion of the rod.

10. The electronic device as claimed in claim 7, wherein the faceplate further comprises a restraining pin, corresponding to the positioning pins and restricting movement of the operation button in a clockwise or counterclockwise motion.

11. The electronic device as claimed in claim 6, wherein the at least one fixing base is L-shaped.

12. The electronic device as claimed in claim 6, wherein the at least one fixing base comprises a bottom portion and a slot disposed therein.

13. The electronic device as claimed in claim 7, wherein the hole of the faceplate is a threaded hole.

14. The electronic device as claimed in claim 13, further comprising a nut, inserted in the hole of the faceplate.

15. The electronic device as claimed in claim 14, wherein the nut comprises at least one pair of concave portions, receiving the positioning pins of the rod.

16. The electronic device as claimed in claim 15, wherein the nut further comprises a restraining pin, disposed between the concave portions.

17. An electronic device comprising:

a faceplate of said electronic device extending along a user-accessible side of said electronic device to cover said side of said electronic device;

at least two switches installable in said electronic device and spaced from said faceplate respectively;

an operation button installable at said faceplate and partially exposable out of said electronic device, said operation button movable through said faceplate to partially extend in said electronic device; and a shaft extending in said electronic device beside said at least two switches and reachable to each of said at least two switches to simultaneously control switching of said at least two switches, said shaft connectively engagable with said operation button extending in said electronic device so as to move together with said operation button in order for simultaneously controlling said switching of said at least two switches based on user-drivable movement of said operation button.

18. The electronic device as claimed in claim 17, wherein said operation button comprises a positioning pin extending therefrom to engage with said faceplate for controlling said user-drivable movement of said operation button.

* * * * *